US010801772B2

(12) United States Patent
Lv et al.

(10) Patent No.: US 10,801,772 B2
(45) **Date of Patent: *Oct. 13, 2020**

(54) HEAT INSULATION DOOR AND REFRIGERATION APPLIANCE WITH THE HEAT INSULATION DOOR

(71) Applicant: BSH HAUSGERAETE GMBH, Munich (DE)

(72) Inventors: Ping Lv, Nanjing (CN); Yaoguo Xu, Nanjing (CN); Chuan Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/835,556

(22) Filed: Dec. 8, 2017

(65) Prior Publication Data

US 2018/0164025 A1 Jun. 14, 2018

(30) Foreign Application Priority Data

Dec. 12, 2016 (CN) ..... 2016 1 1142494

(51) Int. Cl.
*F25D 23/02* (2006.01)
*A47F 3/04* (2006.01)

(52) U.S. Cl.
CPC ..... *F25D 23/02* (2013.01); *A47F 3/0434* (2013.01); *F25D 23/026* (2013.01); *F25D 2201/14* (2013.01); *F25D 2323/023* (2013.01); *F25D 2400/18* (2013.01)

(58) Field of Classification Search
CPC ..... F25D 23/00; F25D 23/02; F25D 23/026; F25D 23/028; A47F 3/0434
USPC ..... 312/401, 405, 116, 138.1
See application file for complete search history.

(56) References Cited

U.S. PATENT DOCUMENTS 4,080,756 A * 3/1978 Heaney ..... A47F 3/043 49/478.1
5,214,877 A * 6/1993 Kaspar ..... A47F 3/043 312/296
5,910,083 A * 6/1999 Richardson ..... E06B 3/66366 312/116
6,052,965 A * 4/2000 Florentin ..... A47F 3/0434 52/786.13

(Continued)

FOREIGN PATENT DOCUMENTS

CN 204535247 * 8/2015

*Primary Examiner* — James O Hansen
(74) *Attorney, Agent, or Firm* — Laurence A. Greenberg; Werner H. Stemer; Ralph E. Locher

(57) ABSTRACT

The heat insulation door of a refrigeration appliance has a door body. The door body includes a heat insulation glass module with at least two layers of glass plates disposed with an interval; a doorframe that surrounds the heat insulation glass module and that includes a rear frame portion located at the back of the heat insulation glass module, and a door sealing strip connected to the back of the rear frame portion. The doorframe further has an enclosed heat insulation cavity, wherein the heat insulation cavity is located between the door sealing strip and the heat insulation glass module along a front-to-rear direction or located on the inner side of the door sealing strip in a direction parallel to the door body. The present invention can improve the heat insulation effect of the refrigeration appliance.

16 Claims, 3 Drawing Sheets

(56) References Cited

U.S. PATENT DOCUMENTS

| | | | | |
|---|---|---|---|---|
| 6,435,630 | B1 * | 8/2002 | Anin | A47F 3/0434 312/116 |
| 8,024,907 | B2 * | 9/2011 | McKinlay | E06B 3/22 49/504 |
| 2002/0056184 | A1 * | 5/2002 | Richardson | A47F 3/0434 29/458 |
| 2009/0007587 | A1 * | 1/2009 | Lanzl | A47F 3/0434 62/449 |
| 2018/0146797 | A1 * | 5/2018 | Artwohl | E06B 7/28 |

* cited by examiner

HEAT INSULATION DOOR AND REFRIGERATION APPLIANCE WITH THE HEAT INSULATION DOOR

CROSS-REFERENCE TO RELATED APPLICATION

This application claims the benefit, under 35 U.S.C. § 119, of Chinese patent application CN 201611142494.2, filed Dec. 12, 2016; the prior application is herewith incorporated by reference in its entirety

BACKGROUND

Technical Field

The present invention relates to the field of refrigeration appliances, in particular to a refrigeration appliance and a heat insulation door thereof.

Related Art

A door of a traditional refrigerator is generally formed by foaming, and a user cannot see the interior of a refrigeration appliance from outside. The refrigeration appliance adopting a heat insulation glass module provides the possibility for the user to observe the interior of a refrigeration space without opening the door. However, if the heat insulation effect of the refrigeration appliance door with the heat insulation glass module is not ideal, condensations are likely to occur on the door.

BRIEF SUMMARY OF THE INVENTION

An objective of the present invention is to provide an improved heat insulation door in order to solve at least one of the technical problems described above.

In order to solve the above problems, the present invention provides a heat insulation door for a refrigeration appliance, comprising a door body, wherein the door body comprises a heat insulation glass module comprising at least two layers of glass plates disposed with an interval; a doorframe that surrounds the heat insulation glass module, wherein the doorframe has a rear frame portion located at the back of the heat insulation glass module; and a door sealing strip connected to the back of the rear frame portion; and the door body further comprises at least one enclosed heat insulation cavity, wherein the heat insulation cavity is located between the door sealing strip and the heat insulation glass module along a front-to-rear direction or located on an inner side of the door sealing strip along a direction parallel to the door body.

Compared with the prior art, the heat insulation cavity of the present invention can play a role in isolation between the refrigeration space and the door body to prevent the cold air from reaching the door body, thereby preventing the door body from having condensation on an outer surface, and improving the heat insulation effect of the heat insulation door.

Optionally, a first sealing portion is disposed between edges of the adjacent glass plates to form an enclosed heat insulation layer between the adjacent glass plates.

Optionally, the door sealing strip is located on the inner side of the first sealing portion in the direction parallel to the door body. Thus, the heat insulation cavity and the door sealing strip are respectively staggered to the first sealing portion along the front-to-rear direction of the door so as to block cold air and to prevent the cold air from being leaked to the front side of the door body, thereby improving the condensation phenomenon.

Optionally, at least one heat insulation cavity is formed in the rear frame portion.

Optionally, at least one heat insulation cavity is formed between the rear frame portion and the door body.

Optionally, there is a gap between the rear frame portion and the door body, and the heat insulation cavity is located in the gap.

Optionally, along the direction parallel to the door body, the inner side of the rear frame portion and the door body are bonded through using glue or sealed by using a sealing member, and the outer side of the rear frame portion and the door body are bonded through using glue or sealed by using a sealing member.

Optionally, the heat insulation glass module is a vacuum glass module or a hollow glass module.

Optionally, the door body further comprises: a front door panel located in front of the heat insulation glass module and disposed with an interval from the heat insulation glass module; and a second sealing portion is disposed between the heat insulation glass module and the front door panel to form an enclosed heat insulation layer between the front door panel and the heat insulation glass module. The front door panel can be used for protecting the heat insulation glass module to prevent the heat insulation glass module from being directly exposed to a range that a user can reach, thereby preventing the breaking probability of the front door panel and also preventing the front door panel when being broken from injuring a user. Moreover, the front door panel can be used as a decoration panel to improve the appearance attractiveness of the heat insulation door.

Optionally, at least one heat insulation cavity is located on the inner side of the second sealing portion along the direction parallel to the door body.

Optionally, in a width and/or length direction of the door body, the front door panel has a protruding portion that extends out of the edge of the heat insulation glass module.

In some embodiments, along the front-to-rear direction of the door, the protruding portion completely shields the doorframe, so that the doorframe is concealed behind the door, and the ornamental performance of the door is improved.

Optionally, the doorframe further comprises: a first cooperative wall located in front of the rear frame portion and at the rear side of the protruding portion, and connected to the protruding portion; a second cooperative wall disposed at the rear frame portion and facing the heat insulation glass module; a connecting wall that connects the first cooperative wall and the second cooperative wall; and along the front-to-rear direction, the heat insulation glass module is located between the first cooperative wall and the second cooperative wall.

Optionally, the heat insulation glass module is directly or indirectly connected to the second cooperative wall.

Optionally, the door body is provided with a sealing portion on the edges of two adjacent layer structures having an interval, and projections of the sealing portions are overlapped with each other along the front-to-rear direction.

Optionally, the second cooperative wall covers the sealing portion. Thus, when the door sealing strip is disposed on the inner side of the rear frame portion, the door sealing strip can be located on the inner side of each sealing portion so as to be staggered to each sealing portion along the front-to-rear direction, thereby improving the heat insulation effect of the heat insulation door.

Optionally, the door body further comprises: a rear protective panel disposed at the back of the heat insulation glass module and disposed with an interval from the heat insulation glass module. The rear protective layer is used for protecting the heat insulation glass module at the back thereof and can be used as a decorative layer on the inner side of the heat insulation door.

Optionally, a third sealing portion is disposed between the edge of the heat insulation glass module and the edge of the rear protective panel to form an enclosed heat insulation layer between the heat insulation glass module and the rear protective panel.

Optionally, at least one heat insulation cavity is located on the inner side of the third sealing portion along the direction of the door body.

Optionally, the front door panel is a colorful crystal glass plate, thereby improving the appearance attractiveness of the heat insulation door.

Optionally, the rear protective panel is a toughened glass plate, a colorful crystal glass plate, or a plastic plate.

Another objective of the present invention is to provide an improved refrigeration appliance, and the refrigeration appliance comprises the heat insulation door of any one described above.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

DETAILED DESCRIPTION

The foregoing objectives, features and advantages of the present invention will become more apparent from the following detailed description of specific embodiments of the invention in conjunction with the accompanying drawings.

Figure 1:
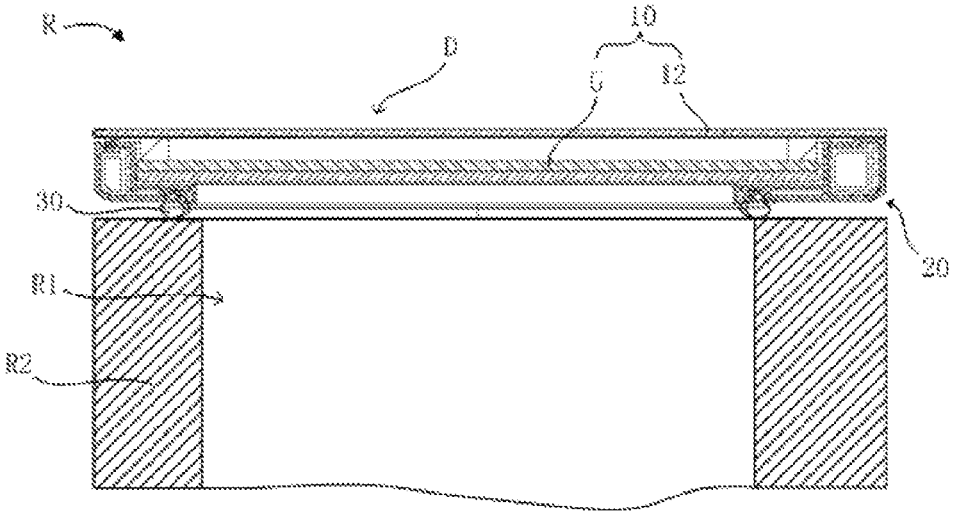
FIG. 1 is a three-dimensional structural schematic diagram of a refrigeration appliance of embodiments of the present invention.
Figure 2:
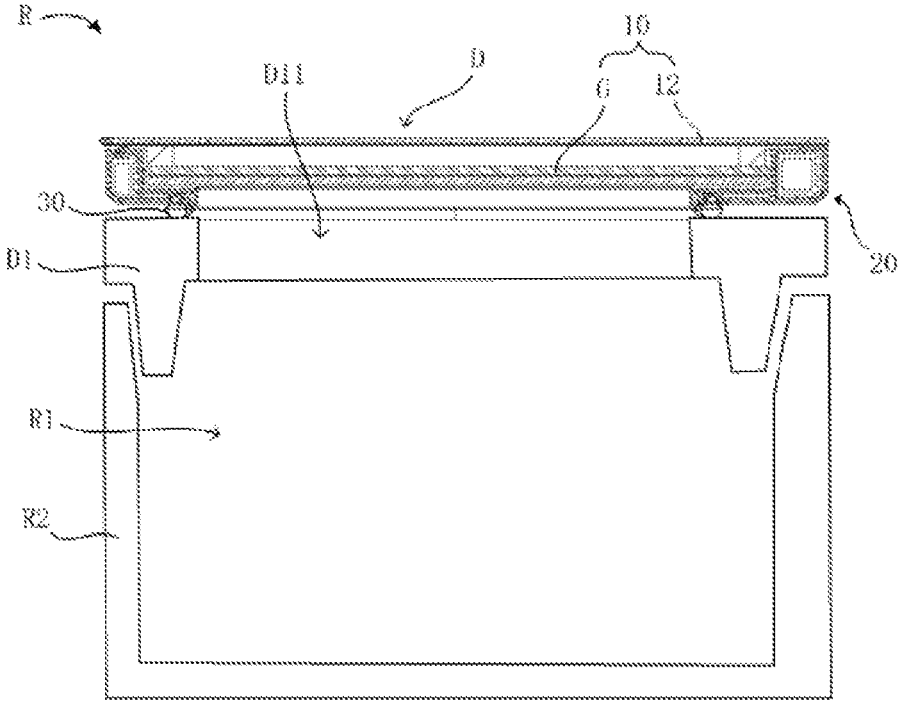
FIG. 2 is a cross-section schematic diagram of a heat insulation door of embodiments of the present invention.

Referring to FIG. 1 and FIG. 2, the present embodiment provides a refrigeration appliance R and a heat insulation door D for the refrigeration appliance R; and the refrigeration appliance R is provided with a box body R2 comprising a refrigeration space R1, and the heat insulation door D is used for sealing the refrigeration space R1. It shall be understood that the refrigeration appliance R may be a refrigerator but is not limited to the refrigerator, and may also be other appliances with the refrigeration space R1 such as a wine cooler, etc.

The refrigeration space R1 of the refrigeration appliance R may be sealed by a layer of heat insulation door D, as shown in FIG. 1. Or, as shown in FIG. 2, an inner door D1 may also be disposed between the heat insulation door D and the box body R2, the inner door D1 may be provided with an opening D11 facing the heat insulation door D, the opening D11 may be used as an accommodating area for accommodating articles, and the heat insulation door D can rotate relative to the inner door D1 so as to open or close the opening D11.

Figure 3:
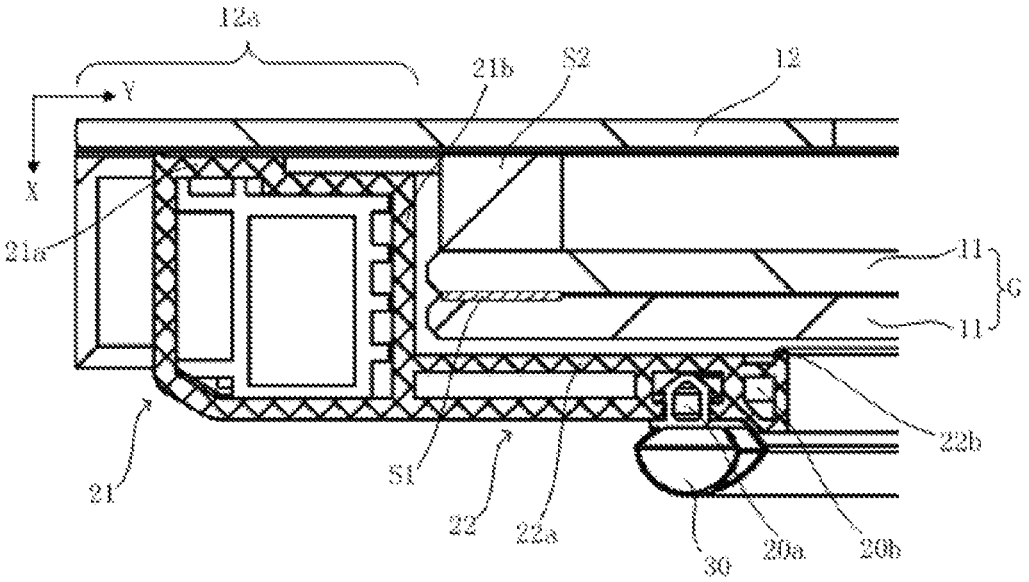
FIG. 3, FIG. 4 and FIG. 5 respectively shows three configurations of a heat insulation layer in the heat insulation door of embodiments of the present invention.

In combination with FIG. 3, FIG. 3 is a cross-section schematic diagram illustrating a local part of one side edge of the heat insulation door D. The heat insulation door D comprises a door body 10 and a doorframe 20. The door body 10 comprises a heat insulation glass module G, and the doorframe 20 surrounds an edge of the heat insulation glass module G along the circumferential direction. As shown in FIG. 1, the doorframe 20 is in an annular shape that surrounds the heat insulation glass module G, and the heat insulation glass module G is disposed in an annular area formed by the doorframe 20.

The heat insulation glass module G comprises at least two glass plates (11) disposed with an interval. As an example, the heat insulation glass module G in the present embodiment comprises two layers of glass plates 11. A first sealing portion S1 is disposed between edges of the adjacent glass plates 11 to form an enclosed heat insulation layer between the adjacent glass plates 11. Generally speaking, the first sealing portion S1 is in an annular shape that surrounds the edges of the glass plates 11. The heat insulation glass module G may be a vacuum glass module or a hollow glass module, and in the present embodiment, the heat insulation glass module is the vacuum glass module, i.e. the heat insulation layer between the two layers of glass plates 11 is a vacuum space.

The doorframe 20 can be divided into a side frame portion 21 and a rear frame portion 22, wherein the side frame portion 21 is located outside a peripheral surface of the heat insulation glass module G, the rear frame portion 22 is located at the back of the heat insulation glass module G along the front-to-rear direction X of the door, and a door sealing strip 30 and a mounting slot 20*a* for fixing the door sealing strip 30 are disposed at the back of the rear frame portion 22. The door sealing strip 30 is used for sealing between the heat insulation door D and a contact surface thereof in a closed state to prevent the leakage of cold air in the refrigeration space R1 of the refrigeration appliance, and the contact surface may be located in the box body (not shown) of the refrigeration appliance or may also be another door.

The heat insulation door D of the present solution further comprises at least one enclosed heat insulation cavity 20*b*. The heat insulation cavity 20*b* can be located between the door sealing strip 30 and the heat insulation glass module G along the front-to-rear direction X, or located on the inner side of the door sealing strip 30 along the direction parallel to the door body 10 (i.e. the direction parallel to the heat insulation glass module G). When the quantity of the heat insulation cavities 20*b* is multiple, some heat insulation cavities 20*b* can be disposed between the door sealing strip 30 and the heat insulation glass module G, and some heat insulation cavities 20*b* are located on the inner side of the door sealing strip 30.

The heat insulation cavity 20*b* of the present solution can play a role in isolation between the refrigeration space R1 and the door body 10 to prevent the cold air from reaching the door body 10, thereby preventing the door body from having condensation on an outer surface, and improving the heat insulation effect of the heat insulation door.

It shall be noted that in the present application, without otherwise specified, the "front-to-rear direction" refers to the front-to-rear direction of the door, i.e. a thickness direction of the door. The "front" is a direction pointing to a front surface of the door, and the "back" is a direction pointing to a back surface of the door. The "inner side" refers to one side, close to the center of the door body, of a plane in which the door body is located, i.e. one side away from the edge of the door.

Preferably, the door sealing strip 30 is at least partially located on the inner side of the first sealing portion S1. On this basis, the heat insulation cavity 20*b* is located on the inner side of the first sealing portion S1, thus, the heat insulation cavity 20*b* and the door sealing strip 30 are respectively staggered to the first sealing portion S1 along the front-to-rear direction of the door so as to block the cold air and to prevent the cold air from being leaked to the front side of the door body, thereby improving the condensation phenomenon.

Figure 4:
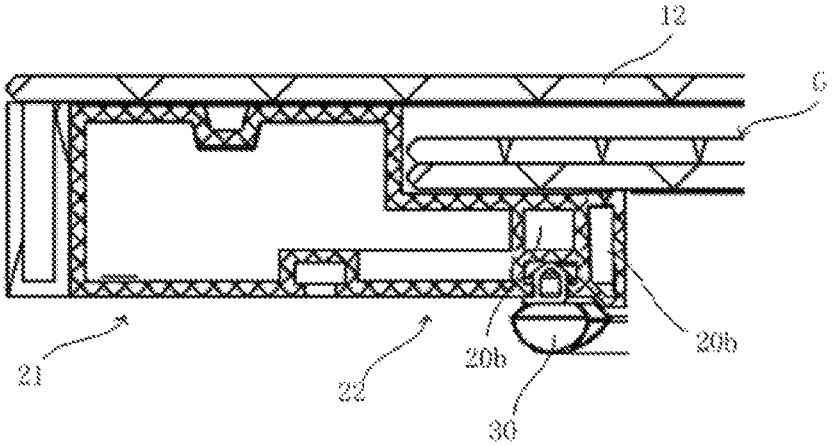

In the present embodiment, as shown in FIG. 3 and FIG. 4, the heat insulation cavity 20*b* can be formed in the rear frame portion 22. wherein, a mounting slot 20*a* for mounting the door sealing strip 30 is not communicated with the heat insulation cavity 20*b*, and the two are separated by a wall. In the embodiment as shown in FIG. 3, the rear frame portion 22 is internally provided with a heat insulation cavity 20*b* located on the inner side of the door sealing strip 30. In the embodiment as shown in FIG. 4, the rear frame portion 22 is internally provided with two heat insulation cavities 20*b*, one heat insulation cavity is located on the inner side of the door sealing strip 30, and the other is located between the door sealing strip 30 and the heat insulation glass module G along the front-to-rear direction X.

Figure 5:
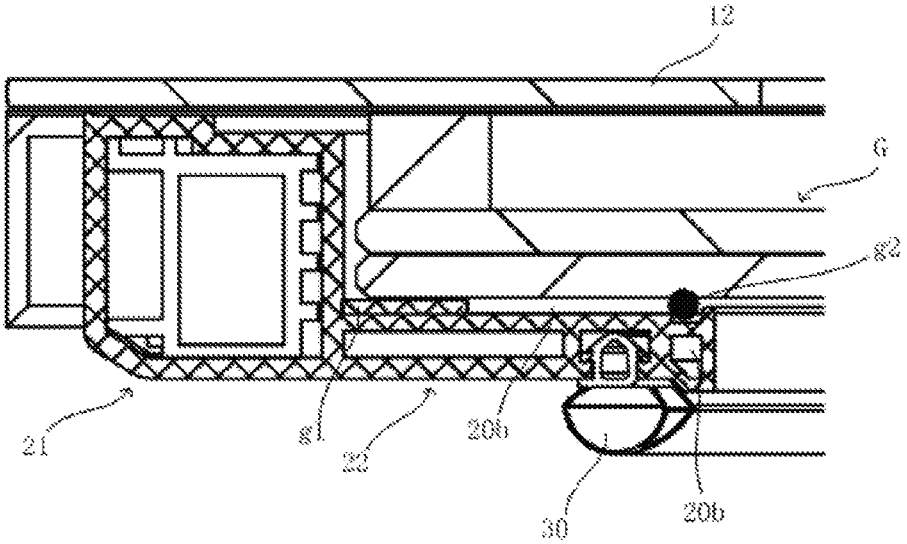

In some other embodiments, referring to FIG. 5, the heat insulation cavity 20*b* can also be formed between the rear frame portion 22 and the door body 10 and is at least partially located on the inner side of the first sealing portion S1. For example, there is a gap between the rear frame portion 22 and the door body 10, and a heat insulation cavity 22*b* is formed in the gap. When the heat insulation cavity 20*b* is located between the rear frame portion 22 and the door body 10, along the direction parallel to the door body 10, the inner side of the rear frame portion 22*b* and the door body 10 are bonded through using glue or sealed by using a sealing member (as shown by a reference numeral g1), and the outer side of the rear frame portion 22 and the door body 10 are bonded through using glue or sealed by using a sealing member (as shown by the reference numeral g2) so as to seal the gap between the rear frame portion 22 and the door body 10 as the heat insulation cavity 20*b*.

Continuously referring to FIG. 3, the door body 10 further comprises a front door panel 12 located in front of the heat insulation glass module G, and the front door panel 12 is disposed with an interval from the heat insulation glass module G. Thus, on one hand, the front door panel 12 can be used for protecting the heat insulation glass module G to prevent the heat insulation glass module G from being directly exposed to a range that a user can reach, thereby preventing the breaking probability of the front door panel and also preventing the front door panel when being broken from injuring a user. On the other hand, the front door panel 12 can be used as a decoration panel to improve the appearance attractiveness of the heat insulation door.

The front door panel 12 may be a toughened glass plate, a colorful crystal glass plate or a plastic plate, and is preferably the colorful crystal glass plate.

As shown in FIG. 3, a second sealing portion S2 is disposed between the edge of the heat insulation glass module G and the front door panel 12 to form an enclosed heat insulation layer between the front door panel 12 and the heat insulation glass module G. The first sealing portion S2 is also basically in an annular shape that surrounds the heat insulation glass module G. In comparison to the intervals among all glass plates 11 in the vacuum glass module, the interval between the front door panel 12 and the heat insulation glass module G can be slightly bigger so as to form a hollow space.

In order to optimize the cold air leakage-proof effect, along the direction parallel to the door body 10, at least one heat insulation cavity 20*b* is located on the inner side of the second sealing portion S2 along the direction parallel to the door body 10. Meanwhile, the door sealing strip 30 is at least partially located on the inner side of the second sealing portion S2 on a same edge so as to increase a travel distance of the cold air from the refrigeration space to the second sealing portion S2, thereby reducing the leakage of the cold air. It can be seen from FIG. 3 that along the front-to-rear direction X of the door, projections of the second sealing portion S2 and the first sealing portion S1 on a same edge are at least partially overlapped and respectively located on the outer side of the heat insulation cavity 20*b*.

An area of the front door panel 12 is based on the fact that the heat insulation glass module G is substantially covered, a dimension and a shape of the front door panel 12 may be basically consistent with that of the heat insulation glass module G or may also be greater than that of the heat insulation glass module G.

In the present embodiment, in a width and/or length direction of the door body 10, the front door panel 12 has a protruding portion 12*a* extending out of an edge of the heat insulation glass module G. The protruding portion 12*a* can be used for shielding other parts, for example, can be used for partially or completely shielding the doorframe 20. In the present embodiment, along the front-to-rear direction of the door, the protruding portion 12*a* completely shields the doorframe 20.

Continuously referring to FIG. 3, the doorframe 20 is internally provided with a first cooperative wall 21*a* located in front of the rear frame portion 22 and at the back of the protruding portion 12*a*, a second cooperative wall 22*a* facing the back of the heat insulation glass module G, and a connecting wall 21*b* that connects the first cooperative wall 21*a* and the second cooperative wall 22*a*.

Specifically, the first cooperative wall 21*a* and the connecting wall 21*b* are disposed on the side frame portion 21, and the second cooperative wall 22*a* is disposed on the rear frame portion 22. The connecting wall 21*b* is located on the inner side of the side frame portion 21 and the outer side of the rear frame portion 22 and surrounds a peripheral edge of the heat insulation glass module G. Along the front-to-rear direction X, the heat insulation glass module G is located between the first cooperative wall 21*a* and the second cooperative wall 22*a*. The protruding portion 12*a* is connected to the first cooperative wall 21*a*, and the heat insulation glass module G may be directly or indirectly connected to the second cooperative wall 22*a*.

In the present embodiment, the rear frame portion 22 is bonded with the door body 10 by using glue through the second cooperative wall 22*a*, the inner side of the rear frame portion 22 is provided with a bulge 22*b* on one side facing the heat insulation glass module G, and the bulge 22*b* is pressed on the door body 10 to prevent the leakage of the glue. Or the position of the bulge 22*b* may be additionally provided with a sealing element or the bulge may be replaced with the sealing element, so as to improve the sealing performance of the refrigeration space.

It shall be noted that besides the heat insulation glass module G and the front protection 12, the door body 10 may further comprise other layer structures which are laminated with the heat insulation glass module G and the front door panel 12. In the door body 10 of a multilayer structure, the edges of two adjacent layer structures having an interval are provided with a sealing portion so as to form a heat insulation layer between two adjacent layer structures, wherein the projections of all sealing portions along the front-to-rear direction X are overlapped with each other. With respect to the door sealing strip 30, in general, the door sealing strip 30 is disposed on the inner side of the rear frame portion 22, and the door sealing strip 30 is preferably located on the inner side of each sealing portion, thus the second cooperative wall 22*a* covers each sealing portion.

Each heat insulation layer between the adjacent layer structures may also be vacuumized, or filled with inert gas so as to improve the heat insulation performance.

Figure 6:
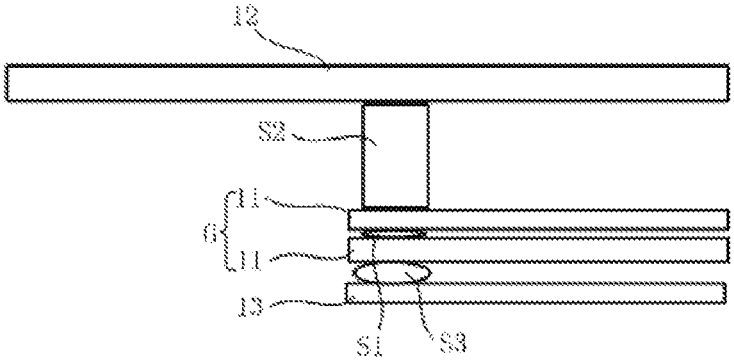
FIG. 6 is a cross-section schematic diagram of a door body of the heat insulation door in another embodiment of the present invention.

In other embodiments, referring to FIG. 6, the door body 10 further comprises a rear protective layer 13 disposed at the back of the heat insulation glass module G and disposed with an interval from the heat insulation glass module G. The rear protective layer 13 is used for protecting the heat insulation glass module G at the back and can be used as a decorative layer on the inner side of the heat insulation door D. The rear protective layer 13 may be a toughened glass plate, a colorful crystal glass plate, or a plastic plate.

A third sealing portion S3 is disposed between the edge of the heat insulation glass module G and the edge of the rear protective layer 13 to form an enclosed heat insulation layer between the heat insulation glass module G and the rear protective layer 13. Preferably, along the direction parallel to the door body 10, the door sealing strip 30 is at least partially located on the inner side of the third sealing portion S3 on a same edge, or at least one heat insulation cavity 20*b* is located on the inner side of the third sealing portion S3 along the direction of the door body 10 so as to reduce the leakage of the cold air. As shown in FIG. 6, along the front-to-rear direction X of the door, projections of the third sealing portion S3 and the first sealing portion S1 and the second sealing portion S2 on a same edge are basically overlapped or at least partially overlapped.

Although the present invention is disclosed as above, the present invention is not limited thereto. Various changes and modifications may be made by any technical skilled in the art without departing from the spirit and scope of the present invention, and the protection scope of the present invention shall be defined by the scope of the claims.

The invention claimed is:

1. A heat insulation door for a refrigeration appliance, the heat insulation door comprising:

a door body, the door body including:

a heat insulation glass module having at least two glass plates disposed at a spacing distance defining an interval;

a first sealing portion disposed between edges of the adjacent glass plates for defining an enclosed heat insulation layer between the glass plates;

a doorframe that surrounds the heat insulation glass module, the doorframe being divided into a rear frame portion located at the back of the heat insulation glass module along a front-to-rear direction of the door and a side frame portion located outside a peripheral surface of the heat insulation glass module;

the rear frame portion having a mounting slot formed therein, the slot being inward of the first sealing portion relative to an edge of the door panel in a direction parallel to the door body;

a door sealing strip mounting in the mounting slot and connected to the back of the rear frame portion;

at least one enclosed heat insulation cavity separate from the mounting slot, the heat insulation cavity having a completely enclosed cross section and being adjacent the mounting slot inwardly of the mounting slot in a direction parallel to a main extent of the door body, the heat insulation cavity being provided internally in the rear frame portion.

2. The heat insulation door according to claim 1, wherein at least one heat insulation cavity is formed between the rear frame portion and the door body.

3. The heat insulation door according to claim 2, wherein there is a gap between the rear frame portion and the door body, and the heat insulation cavity is located in the gap.

4. The heat insulation door according to claim 3, wherein along a direction parallel to the door body, an inner side of the rear frame portion and the door body are bonded by glue or are sealed by way of a sealing member, and an outer side of the rear frame portion and the door body are bonded by glue or are sealed by way of a sealing member.

5. The heat insulation door according to claim 1, wherein the heat insulation glass module is a vacuum glass module and/or a hollow glass module.

6. The heat insulation door according to claim 1, wherein the door body further comprises:

a front door panel located in front of the heat insulation glass module disposed with an interval from the heat insulation glass module; and a second sealing portion is disposed between the edge of the heat insulation glass module and the front door panel to form an enclosed heat insulation layer between the front door panel and the heat insulation glass module.

7. The heat insulation door according to claim 6, wherein in a width and/or length direction of the door body, the front door panel has a protruding portion that extends out of the edge of the heat insulation glass module.

8. The heat insulation door according to claim 7, wherein the protruding portion completely shields the doorframe along the front-to-rear direction of the door.

9. The heat insulation door according to claim 7, wherein the doorframe further comprises:

a first cooperative wall, located in front of the rear frame portion and at the back of the protruding portion, wherein the first cooperative wall is connected to the protruding portion;

a second cooperative wall, disposed at the rear frame portion towards the heat insulation glass module; and a connecting wall that connects the first cooperative wall and the second cooperative wall along the front-to-rear direction, and the heat insulation glass module is located between the first cooperative wall and the second cooperative wall.

10. The heat insulation door according to claim 9, wherein the heat insulation glass module is directly or indirectly connected to the second cooperative wall.

11. The heat insulation door according to claim 6, wherein the front door panel is a colorful crystal glass plate.

12. A refrigeration appliance, comprising an insulation door according to claim 1.

13. The heat insulation door according to claim 1, which further comprises an enclosed heat insulation cavity formed between the sealing strip of the door and the heat insulation glass module along a front-to-rear direction.

14. A heat insulation door for a refrigeration appliance, the heat insulation door comprising:

a door body, the door body including:

a heat insulation glass module having at least two glass plates disposed at a spacing distance defining an interval;

a first sealing portion disposed between edges of the adjacent glass plates for forming an enclosed heat insulation layer between the glass plates;

a front door panel located in front of the heat insulation glass module disposed with an interval from the heat insulation glass module; and a second sealing portion disposed between the edge of the heat insulation glass module and the front door panel for forming an enclosed heat insulation layer between the front door panel and the heat insulation glass module;

a doorframe that surrounds the heat insulation glass module, the doorframe being divided into a rear frame portion located at the back of the heat insulation glass module along a front-to-rear direction of the door and a side frame portion located outside a peripheral surface of the heat insulation glass module;

the rear frame portion having a mounting slot formed therein, the slot being inward of the first sealing portion relative to an edge of the door panel in a direction parallel to the door body;

a door sealing strip mounting in the mounting slot and connected to the back of the rear frame portion;

at least one enclosed heat insulation cavity separate from the mounting slot, the heat insulation cavity having a completely enclosed cross section and being adjacent the mounting slot inwardly of the mounting slot in a direction parallel to a main extent of the door body, the heat insulation cavity being provided internally in the rear frame portion;

the at least one heat insulation cavity being located on an inner side of the second sealing portion in a direction parallel to the door body.

15. A heat insulation door for a refrigeration appliance, the heat insulation door comprising:

a door body, the door body including:

a heat insulation glass module having at least two glass plates disposed at a spacing distance defining an interval;

a first sealing portion disposed between edges of the adjacent glass plates for forming an enclosed heat insulation layer between the glass plates;

a front door panel located in front of the heat insulation glass module disposed with an interval from the heat insulation glass module; and a second sealing portion disposed between the edge of the heat insulation glass module and the front door panel for forming an enclosed heat insulation layer between the front door panel and the heat insulation glass module;

a doorframe that surrounds the heat insulation glass module, the doorframe being divided into a rear frame portion located at the back of the heat insulation glass module along a front-to-rear direction of the door and a side frame portion located outside a peripheral surface of the heat insulation glass module;

the rear frame portion having a mounting slot formed therein, the slot being inward of the first sealing portion relative to an edge of the door panel in a direction parallel to the door body;

the doorframe further including:

a first cooperative wall, located in front of the rear frame portion and at the back of the protruding portion, wherein the first cooperative wall is connected to the protruding portion;

a second cooperative wall, disposed at the rear frame portion towards the heat insulation glass module; and a connecting wall that connects the first cooperative wall and the second cooperative wall along the front-to-rear direction, and the heat insulation glass module is located between the first cooperative wall and the second cooperative wall;

a door sealing strip mounting in the mounting slot and connected to the back of the rear frame portion;

at least one enclosed heat insulation cavity separate from the mounting slot, the heat insulation cavity having a completely enclosed cross section and being adjacent the mounting slot inwardly of the mounting slot in a direction parallel to a main extent of the door body, the heat insulation cavity being provided internally in the rear frame portion;

in a width and/or length direction of the door body, the front door panel having a protruding portion extending out of the edge of the heat insulation glass module;

the first and second sealing portions being overlapped with each other with respect to a direction parallel to the door body.

16. The heat insulation door according to claim 15, wherein the second cooperative wall covers the first and second sealing portions.

* * * * *